US006935760B2

(12) United States Patent
Bar-Cohen

(10) Patent No.: US 6,935,760 B2
(45) Date of Patent: Aug. 30, 2005

(54) ULTRASONICALLY INDUCED PLUMBING-FREE CONTROLLABLE PLURALITY OF FOUNTAINS AND FOG (ULIFOG)

(76) Inventor: Yoseph Bar-Cohen, 3721 Fuchsia St., Seal Beach, CA (US) 90740

( * ) Notice: Subject to any disclaimer, the term of this patent is extended or adjusted under 35 U.S.C. 154(b) by 158 days.

(21) Appl. No.: 10/657,111

(22) Filed: Sep. 9, 2003

(65) Prior Publication Data

US 2005/0052866 A1 Mar. 10, 2005

(51) Int. Cl.[7] ..... F21V 33/00

(52) U.S. Cl. ..... 362/96; 362/253; 362/811; 239/102.2; 239/211; 40/407; 40/439

(58) Field of Search ..... 362/96, 253, 811; 239/102.2, 211; 40/407, 439

(56) References Cited

U.S. PATENT DOCUMENTS 4,305,117 A * 12/1981 Evans ..... 362/96
6,030,108 A * 2/2000 Ishiharada et al. ..... 362/562
6,296,196 B1 * 10/2001 Denen et al. ..... 239/4
6,799,730 B2 * 10/2004 Peng et al. ..... 239/102.2

* cited by examiner

*Primary Examiner*—Stephen Husar
*Assistant Examiner*—James Cranson

(57) ABSTRACT

The present invention provides a design of an apparatus that controllably generates plurality of fountains or fog. The apparatus comprises of a plurality of concave focused transducers that are immersed in a fluid with the focus located at the fluid surface. The apparatus is further comprises of a function generator that generates cyclic signals in the Megahertz range that drives the transducers at one or more of their resonance frequencies. The apparatus comprises of a sound emitting device that include a computer controlled generator, music device or synthesizer that is used to modulate the drive signal to the transducers. The apparatus is further comprised of an amplifier that drives the transducers to produce high-intensity ultrasonic waves. The apparatus comprises of a light source that illuminates the produced fountains or fog. The full embodiment of the invention consists of drive electronics that generate cyclic signals that are modulated by sound of music or other rhythmic signals. These signals drive a plurality of transducers to produce fountains or fog that are harmoniously illuminated by a light source to provide audiovisual effects. One modality of the invention consists of a laser source that raster scan the fog or fountains to generate three-dimensional display. The object of this invention is to provide for the design of a source of electrically controlled fountain and fog. It is further the object of this invention to provide for the design of a device that synchronously varies the level of appearance of the fountains and fog with the rhythm of a played sound of music or synthesized signals. It is further the objective of this invention to provide for a design of a device that harmoniously presents light interaction with the produced fountains and fog.

4 Claims, 3 Drawing Sheets

ULTRASONICALLY INDUCED PLUMBING-FREE CONTROLLABLE PLURALITY OF FOUNTAINS AND FOG (ULIFOG)

BACKGROUND OF THE INVENTION

The present Ultrasonically Induced Plumbing-Free Controllable Plurality of Fountains and Fog (ULIFOG) invention is a mechanism that synchronizes that produced fountains and fog with projected light and emitted rhythmic sound. This invention is comprised of no mechanical components. It is applicable to entertainment, toys, home or office use as well as other applications where there is a need to create fountains or fog with the ability to electrically control the height of the fountains and the volume of produced fog. Electrically controlled fountains and fog are used for displays, decoration, special effects, simulators and many other applications.

Commercial electrically controlled water fountains, which are displayed in buildings, gardens and other places, are illuminated by projected light and the scattering of the light by the water droplets generates a decoration effect. When combined with music an audiovisual effect is formed. Fogging devices are widely used for special effects in theaters and dance halls and when combined with rasters of laser beams various visual patterns and dynamic three-dimensional projections are displayed. Foggers are also used as humidifiers to help sufferers of cold, sore throat and asthma symptoms as well as benefit indoor plants.

Conventional mechanisms of producing fountains and fog require plumbing, valves, and pumps that are complex, constrained in response time by the speed of movement of the mechanical elements, subjected to mechanical failure and they require maintenance to assure reliable operation.

It is well recognized that there is a need for a maintenance-free, simple mechanism that can rapidly respond with as closed to real time as possible. Efforts are continually being made to improve the existing technology towards more reliable, simpler and faster mechanisms. A system that can produce fountains directly from the surface of a fluid bath without the need for any mechanical components offers significant benefits in reliability and speed of response in reaction to electric stimulation. The stimulated signal can be synchronized with the rhythm of sound that can be generated by music devices, synthesizers, or computer programmed tasks. It is thus the object of this invention to create fountains and fog using no pumps, valves or plumbing, and provide a highly controllable, fast to response, simple configuration tool to support the needed technology. Further objective of this invention is to provide a design that does not require plumbing maintenance that produces fountains and fog that vary its appearance synchronously with sound rhythm that is harmonious with projected light.

SUMMARY OF THE INVENTION

The present invention is embodied in using high-intensity focused ultrasonic waves that selectively produce fountains and fog that vary its appearance synchronously with the rhythm of sound and harmoniously with projected light. The present invention consists of a plurality of piezoelectric concave focused transducers that are immersed in a fluid with their focus located at the fluid surface. The transducers are connected to a drive electronic system that activates the transducers in one or more of their resonance frequencies to selectively produce fountains and fog. The formation of both the fountains and fog occurs in microseconds when operated at Megahertz frequencies and upon termination of the driving signal the effect of forming fountain and fog is instantly turned off. Selecting the frequency and controlling the intensity of the emitted ultrasonic waves determine the type and the level of the presented effect varying it from fountains, through a combination of fountains and fog, to the appearance of fog only. A sound source that includes music device, synthesizer, or computer generated signals is used to emit rhythmic sound and to synchronize the level of appearance of the fountains and fog. Projected rays of colored light or laser beams that illuminate the produced fountains and fog are synchronized with the rhythm of a played sound. The rays are scattered by the fluid droplets producing a dynamic and vivid display that is harmonized with the played sound. To project real time three-dimensional images the fog can be illuminated with a raster of laser beams. Further, it is envisioned that other features which employ electrically controlled fountains and fog without the need for plumbing can be enabled with this invention.

In fluids, high intensity focused ultrasonic waves produce the phenomenon of streaming at the focal zone. When directed onto the surface of the fluid, the steaming fluid applies pressure onto the surface causing the formation of a fluid column in the shape of a fountain. Further, due to the excitation of cavitations and atomization high intensity ultrasonic waves produce fog. The frequency and intensity of the ultrasonic wave determine the degree to which these two phenomena appear. Laboratory experiments have shown that at certain frequencies these phenomena can be produced separately or jointly allowing the selection of the desired effect. The level of appearance of the fountains and fog respond to variations in the drive signals in microseconds and it is highly responsive presentation that is synchronized with sound of music harmonically varying with projected light.

BRIEF DESCRIPTION OF THE DRAWINGS

The invention will be more understood from the following detailed description of the representative embodiment thereof read in conjunction with the accompanying drawings wherein.

DETAILED DESCRIPTION OF THE PREFERRED EMBODIMENT

Figure 1:
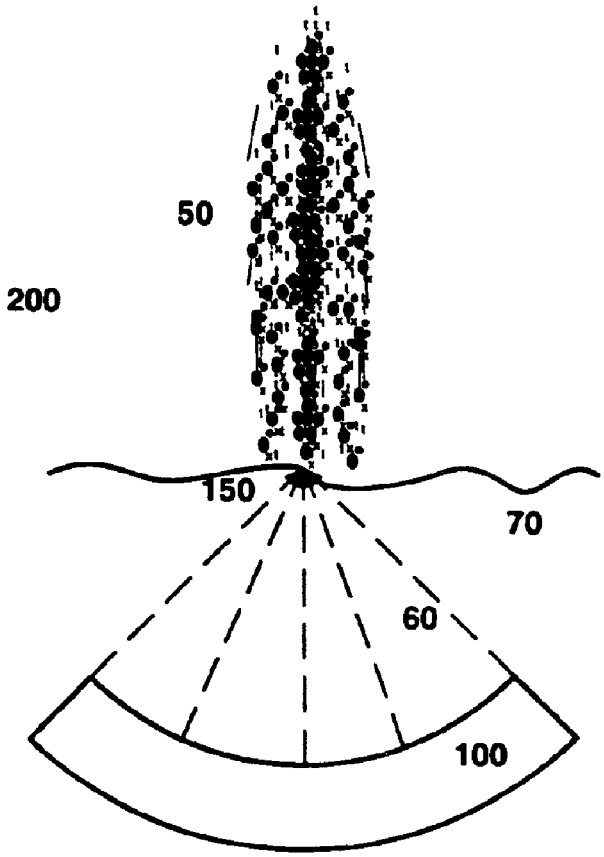
FIG. 1 is a cross sectional view of a partial embodiment of the ULIFOG system using a single transducer.
Figure 2:
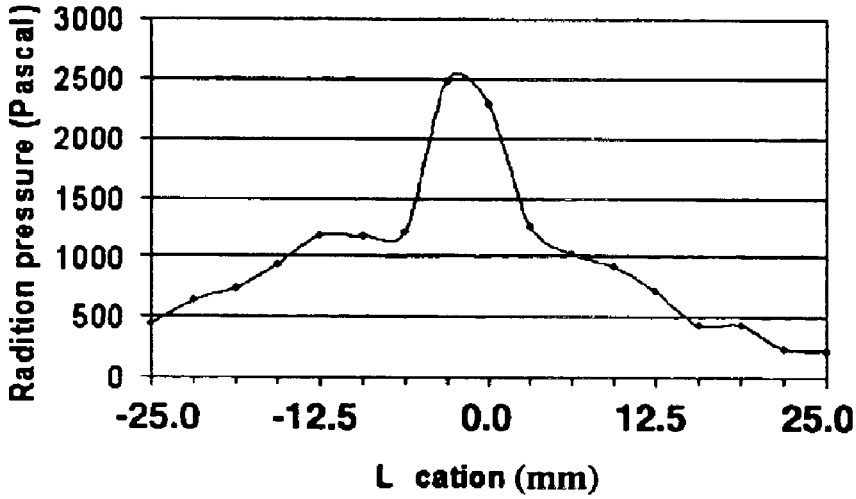
FIG. 2 shows the measured pressure that is generated by the ultrasonic wave at the transducer focus that is located at the water surface
Figure 3:
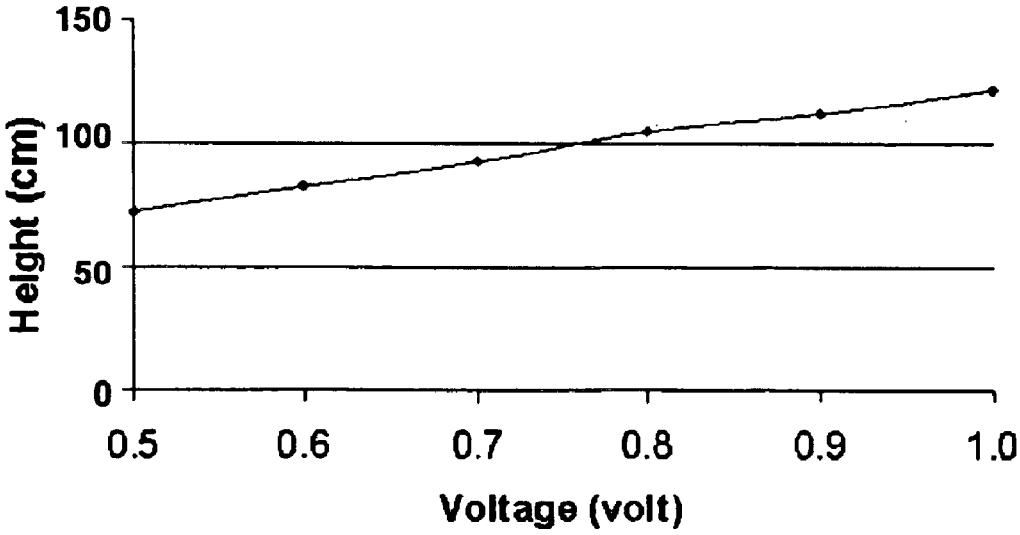
FIG. 3 shows the relation between the drive voltage, which is amplified by a gain of 55 dB prior to driving the transducer, and the height of the produced fountain.
Figure 4:
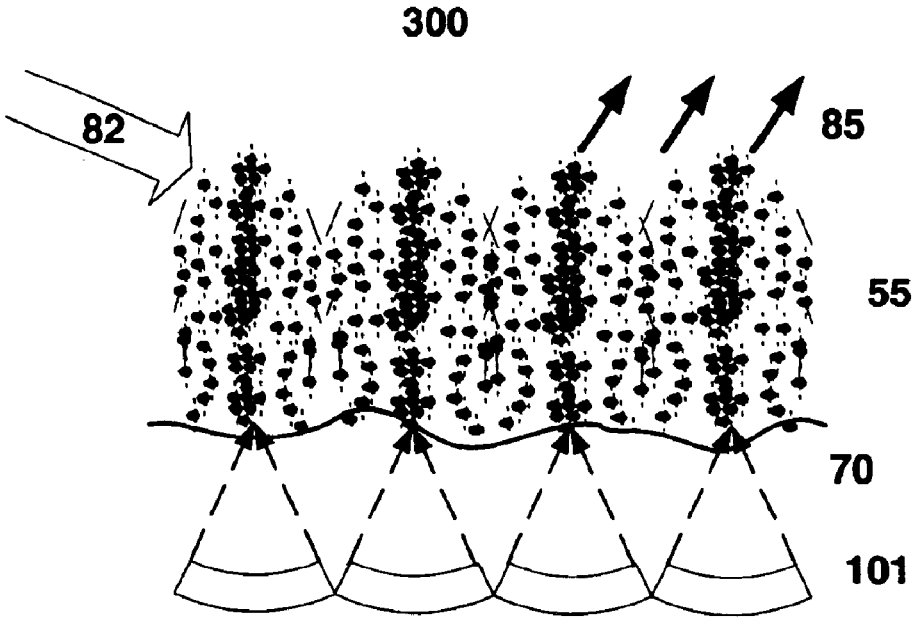
FIG. 4 is a view of the embodiment of the ULIFOG invention with plurality of transducers, the produced fountain and the projected light.
Figure 5:
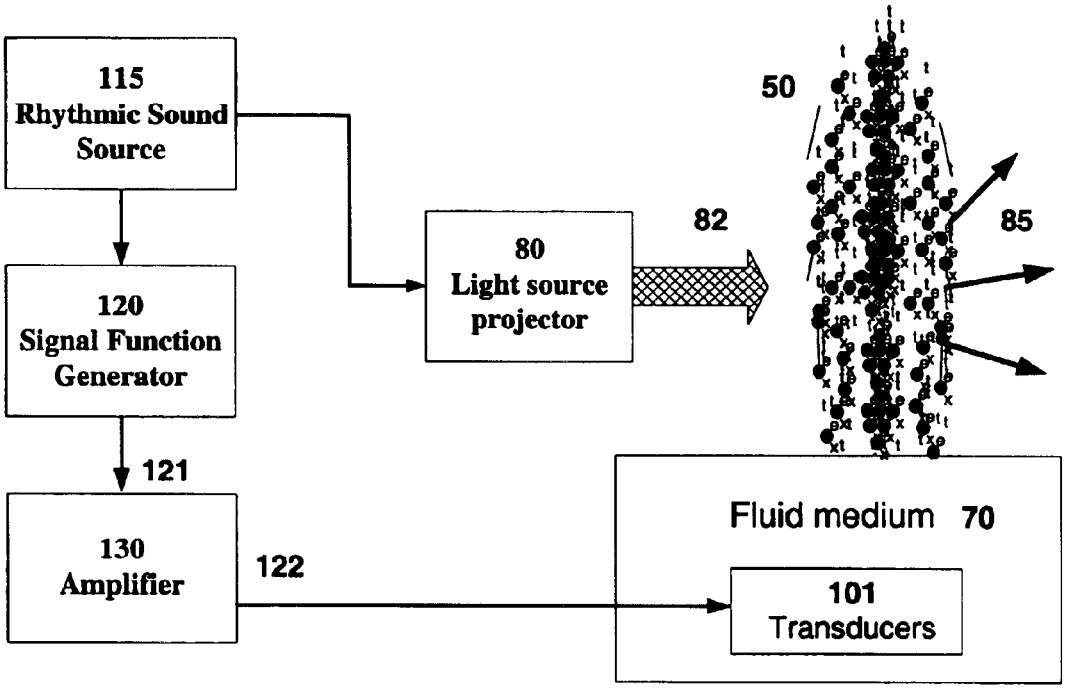
FIG. 5 is a block diagram of an embodiment of a ULIFOG system.

In the following description of the preferred embodiment, reference is made to the accompanying drawings, which form a part thereof, and in which by way of illustration, a specific embodiment of the invention may be practiced. It is to be understood that other embodiments may be utilized and structural changes may be made without departing from the scope of the present invention. FIG. 1 is a cross sectional partial view of the ULIFOG system using one focused, transducer. FIG. 2 shows an experimental pressure level at the water surface that is generated by a high-intensity focused ultrasonic wave. FIG. 3 shows experimental data for the relation between the drive voltage and the fountain height. The signal is amplified by a gain of 55 dB prior to driving the transducer. FIG. 4 is a view of the embodiment of the invention comprising of a plurality of transducers that produce plurality of fountains. FIG. 4 also shows the projected and scatters light. FIG. 5 shows a block diagram of the embodiment of the ULIFOG invention.

FIG. 1 represents part 200 of the embodiment of the present ULIFOG invention comprising of a high intensity focused transducer 100 that is immersed in a fluid medium 70. The individual transducer 100 is configured concave and the emitted ultrasonic waves 60 converge at the focal zone 150 of this focused transducer 100. The emitted focused ultrasonic wave travels through the fluid medium and produces the effect of streaming pushing the fluid forward along the wave path. Upon positioning the focal zone 150 of the transducer 100 at the surface of the fluid 70 the ultrasonic pressure of the steaming fluid produces a column in the shape of a fountain 50. The frequencies that induce fountains in water for the geometry of the transducer 100 described in this embodiment include 263, 757, 772-KHz, and 1.65-MHz. The fountains can be replaced by fog by changing the frequency of the drive signals to 521-KHZ causing atomization of the water at the focal zone 150. Upon using a frequency of 460-KHz the transducer produces a strong cavitation effect at the focal zone 150 and this effect provides a tool for cleaning of surfaces of part as well as removing paint. FIG. 2 presents data for the radiation pressure of the focused ultrasonic wave that is used to generate a water fountain of about 1.25 meter high by a 10-cm diameter piezoelectric transducer made of PZT with 10-cm focal length that is driven at the resonance frequency of 772-kHz. FIG. 3 represents the height of the fountain as a function of the applied voltage for a drive sinusoidal signal that is amplified by a gain of 55 dB prior to activating the transducer.

FIG. 4 represents the embodiment of the invention with a plurality of transducers 101 that are immersed in a fluid medium 70 and the ultrasonic waves 60 are focused onto the surface of the fluid 150. A projected light 82 with a plurality of colors illuminates the fountains 55 and produce a vivid visual effect of dynamics movement of the fluid drops that is presented by the scattered light. Since no pumps, valves, plumbing, or other mechanical components are needed to produce the fountains and fogs, and since the phenomenon occurs at the speed of sound, ULIFOG 300 responds in microseconds when operated in the Megahertz frequency range. The light source 80 can comprise of a light projector or a laser beam with raster scanning capability that illuminates the plurality of fountains 55. The presence of many droplets in the fountain scatters the light and cause the formation of colorful vivid light patterns. FIG. 5 represents a block diagram of the drive electronics. The signals that generate the fountains and fog 122 are modulated by a rhythmic sound that is generated by various sound sources 115 modalities including a computer generated signal, a synthesizer or a music source. The music source includes radio, tape recorder, recorded disk and other forms of recoded music. Modulating the emission of the light 82 from the source 80 synchronizes the variations in the scattered light 85 with the changes in the injected fluid height or fog 55. This modulation causes the fountains high and the fluid flow rate to vary synchronously with the rhythm of the sound of music and creates controllable audiovisual effects.

What is claimed:

1. An apparatus that produces plurality of focused ultrasonic waves onto the surface of fluid generating controlled fountains or fog, comprising of a. A plurality of concave focused piezoelectric transducers immersed in a fluid, b. A signal function generator that drives the individual transducers with a cyclic signal at one or more of their resonance frequencies, c. A sound emitter comprising of a computer controlled signal generator, music emitting device, or sound synthesizer source that produces signals that modulates the cyclic signal drives the transducers, d. An amplifier that amplifies the drive signals to generate high power ultrasonic waves by the transducers, e. A light generator that illuminates the fountains and fog.

2. The apparatus of claim 1, wherein said comprising of concave curved piezoelectric transducers with air backing that radiates ultrasonic waves in the forward direction.

3. The apparatus of claim 1, further comprising of a controllable generator that changes the drive frequency of the transducer to emit plurality of effects that include fountains, fog and their combinations.

4. The apparatus of claim 1, further comprising of a controllable generator that drives synchronously the appearance of fountains and fogs, harmoniously with projected light at the rhythm of sound.

* * * * *